US006331129B1

(12) United States Patent
Earley

(10) Patent No.: US 6,331,129 B1
(45) Date of Patent: Dec. 18, 2001

(54) DEVICE FOR MARKING SWIMMING POOL LANE DIVIDERS

(76) Inventor: William L. Earley, 475 C Ave., Coronado, CA (US) 92118

( * ) Notice: Subject to any disclaimer, the term of this patent is extended or adjusted under 35 U.S.C. 154(b) by 0 days.

(21) Appl. No.: 09/641,420

(22) Filed: Aug. 16, 2000

Related U.S. Application Data

(60) Provisional application No. 60/149,231, filed on Aug. 16, 1999.

(51) Int. Cl.[7] ..... B63B 22/00
(52) U.S. Cl. ..... 441/133
(58) Field of Search ..... 441/133; 4/505

(56) References Cited

U.S. PATENT DOCUMENTS 3,597,779 * 8/1971 Morgan ..... 441/133
3,757,370 * 9/1973 Seno et al. ..... 441/133
5,564,358 * 10/1996 Newton ..... 114/361

OTHER PUBLICATIONS

Defender Industries, Jan.–1992, pp. 30 and 35, New Rochelle, N.Y.*

* cited by examiner

*Primary Examiner*—Stephen Avila
(74) *Attorney, Agent, or Firm*—Gary L. Eastman

(57) ABSTRACT

A device for marking swimming pool floating lane dividers includes a thin, flat rectangular sheet of brightly colored polyethylene with a top edge, a bottom edge, a left edge, and a right edge. The device for marking swimming pool floating lane dividers may be wrapped around a typical swimming pool lane divider with the top and bottom edges overlapping each other. Holes formed along the top and bottom edges allow fasteners to be inserted through the holes to hold the device in place around a swimming pool floating lane divider.

15 Claims, 4 Drawing Sheets

DEVICE FOR MARKING SWIMMING POOL LANE DIVIDERS

This application claims benefit to Provisional Application 60/549,231 filed Aug. 16, 1999.

FIELD OF THE INVENTION

The present invention relates generally to swimming pool accessories. More specifically, the present invention pertains to floating lane dividers. The present invention is particularly, though not exclusively, useful for marking distances on swimming pool floating lane dividers.

BACKGROUND OF THE INVENTION

Prior to 1994, during competitive swimming events, the swimmers were allowed to swim underwater as long as they could before surfacing and performing the required stroke. In 1994, the Federation Internationale de Natation Amateur (FINA), the world-wide governing body for competitive swimming, issued a new rule stating that during backstroke races, the swimmers' heads must break the surface of the water within fifteen meters (15 m) of the pool end walls when either starting the race or making turns. In 1998, FINA extended this fifteen meter (15 m) rule to freestyle races and butterfly races, as well.

In response to these rule changes issued by FINA, USA Swimming and U.S. Masters Swimming adopted the following rule: "Distinctive colored floats, or markers extending around the full circumference of the floats, shall be placed at 15 meters (49 feet, 2½ inches) from each end wall in both short course and long course pools." Marking the fifteen meter (15 m) distance not only allows the swimmers to know when to surface, but it also allows the race officials to determine who is, or who is not, following this rule.

Various lane line marking devices, such as fabric covers, notched inserts, and colored segments, have been used to mark the fifteen meter (15 m) distance. Unfortunately, each of these devices present problems to the users. The fabric covers do not readily withstand the harsh chemicals used to keep the pool clean, and in outdoor pools, they quickly fade in the sunlight.

The notched inserts are difficult to see from underwater and can be dislodged by the wave action of the swimmers. Additionally, they may be dislodged when the lane markers are removed from the pool and placed on storage reels. The colored segments may provide a solution to the problem, but they cannot be easily retrofitted on existing floating lane dividers. It is also difficult to move or change the colored segments, if necessary.

In response to the above problems, there is a need for a device that can be used to mark swimming pool lane dividers which can withstand harsh pool chemicals and continuous sunlight. There is also a need for a marking device that cannot be easily dislodged from the swimming pool lane dividers by wave action, and/or removal and storage of the lane dividers. Finally, there is also a need for a device that can be easily retrofitted onto to existing swimming pool lane dividers.

Accordingly, it is an object of the present invention to provide a device for marking swimming pool lane dividers that will withstand chlorine and other chemicals used to maintain swimming pools. It is another object of the present invention to provide a device for marking swimming pool lane dividers that will not fade or otherwise degrade under intense continuous sunlight. It is another object of the present invention to provide a device for marking swimming pool lane dividers which can be easily retrofitted onto existing floating lane lines.

It is another object of the present invention to provide a device for marking swimming pool lane dividers that can be easily installed, removed and changed, if necessary. It is yet another object of the present invention to provide a device for marking swimming pool lane dividers which is simple to manufacture and relatively inexpensive.

SUMMARY OF THE PRESENT INVENTION

The device for marking swimming pool lane dividers of the present invention includes a thin, flat rectangular sheet of brightly colored polyethylene with a top edge, a bottom edge, a left edge, and a right edge. The device for marking swimming pool lane dividers may be formed with two (2) or more holes along the top edge and the bottom edge.

The device for marking swimming pool lane dividers may be wrapped around a typical swimming pool lane divider with the top and bottom edges overlapping each other. When properly installed, the holes formed along the top and bottom edges will line up to allow a fastener to be inserted through them to hold the device for marking swimming pool lane dividers in place around the swimming pool lane divider. The fasteners will also prevent the device for marking swimming pool lane dividers from sliding along the swimming pool lane divider. Moreover, the fasteners may be easily removed to allow the device for marking swimming pool lane dividers to be removed, changed, or moved to another distance from the end walls of the pool.

This device for marking swimming pool lane dividers overcomes many of the disadvantages of the markers discussed above because it provides a lane line marker which is resistant to the degradation caused by harsh pool chemicals and continuous sunlight. Moreover, this device for marking swimming pool lane dividers provides a lane line marker which can be easily retrofitted onto existing floating lane dividers. Finally, this device for marking swimming pool lane dividers provides a lane line marker which can be easily removed, easily changed, and easily moved along a swimming pool lane divider.

DESCRIPTION OF THE DRAWINGS

The novel features of this invention, as well as the invention itself, both as to its structure and its operation, will be best understood from the accompanying drawings, taken in conjunction with the accompanying description, in which reference characters refer to similar parts, and in which.

DETAILED DESCRIPTION OF A PREFERRED EMBODIMENT

Figure 1:
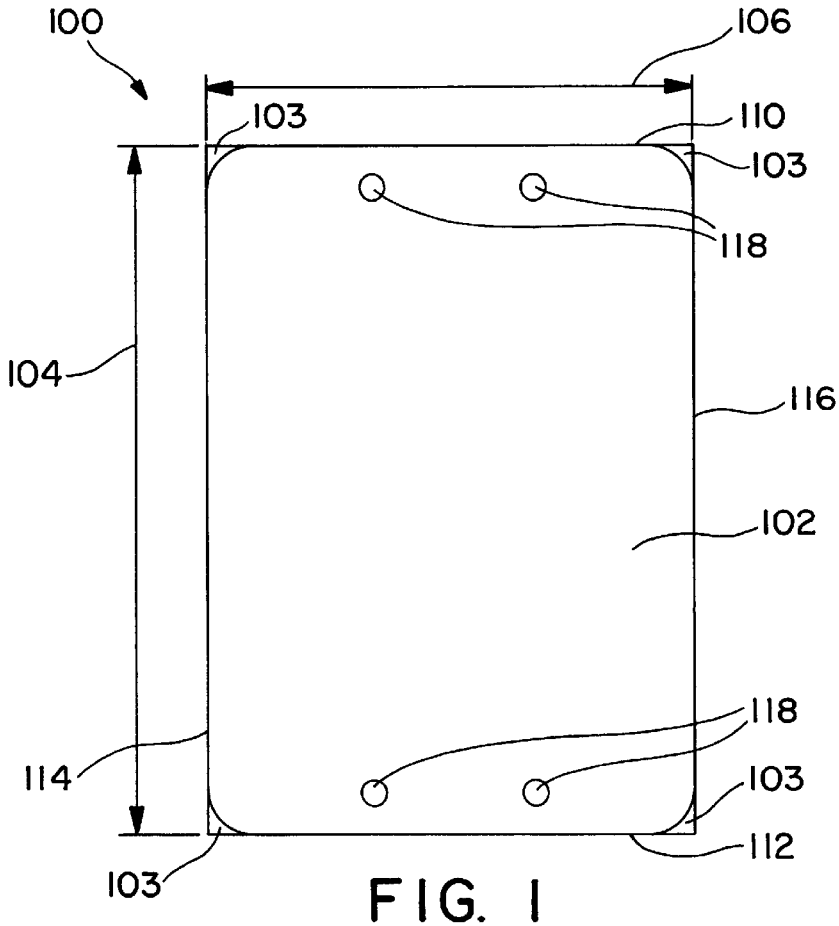
FIG. 1 is a front plan view of the Device For Marking Swimming Pool Lane Dividers of the present invention.

Referring initially to FIG. 1, the device for marking swimming pool lane dividers is shown and generally designated 100. The device for marking swimming pool lane dividers 100 includes a thin, flat rectangular 102 sheet having a length 104, a width 106, and referring briefly to FIG. 3, a thickness 108. As a safety precaution, all four (4) corners 103 of the device for marking swimming pool lane dividers 102 may be angled or rounded to eliminate any sharp edges. FIG. 1 shows that the device for marking swimming pool lane dividers 100 also has a top edge 110, a bottom edge 112, a left edge 114, and a right edge 116. The device for marking swimming pool lane dividers 100 may be formed with one or more holes 118 along the top edge 110 and the bottom edge 112 sized to receive fasteners 120, shown in FIG. 4.

Figure 2:
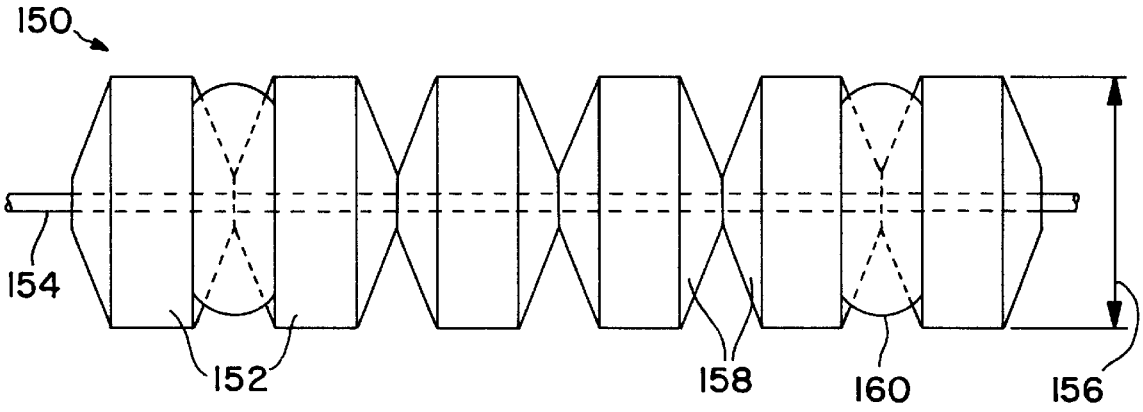
FIG. 2 is a side plan view of a typical swimming pool lane divider.

Referring now to FIG. 2, a typical swimming pool lane divider is shown and generally designated 150. The swimming pool lane divider 150 includes a plurality of independent sections 152 installed over a plastic coated cable 154. Each section 152 has a diameter 156 and includes baffles 158 which allow water to pass between the sections 152. The swimming pool lane divider 150 may also include a plurality of floats 160 intermittently installed along the length of the swimming pool lane divider 150 between the independent sections 152 to provide the necessary buoyancy to the pool lane divider 150.

Figure 3:
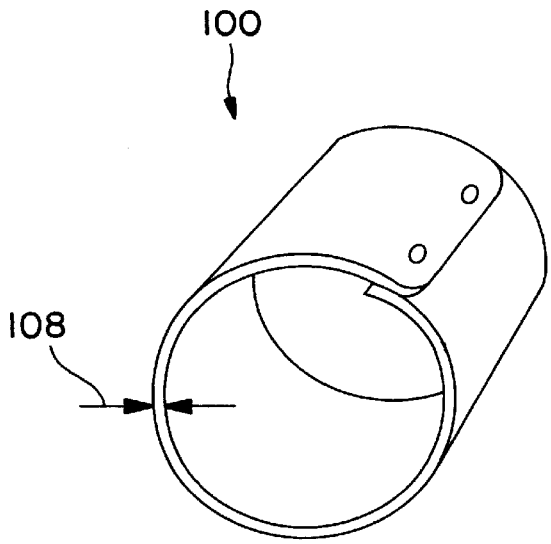
FIG. 3 is a perspective view of the Device For Marking Swimming Pool Lane Dividers of the present invention when rolled up.

FIG. 3 shows the device for marking swimming pool lane dividers 100 configured as it would be when installed around the swimming pool lane divider 150 shown FIG. 2. In this configuration, the top and bottom edges 110 and 112 may overlap each other so that the holes 118 formed along each edge 110 and 112 align with each other. Once aligned, the fasteners 120 may be inserted through the holes 118 to hold the device for marking swimming pool lane dividers 100 in place.

Figure 4:
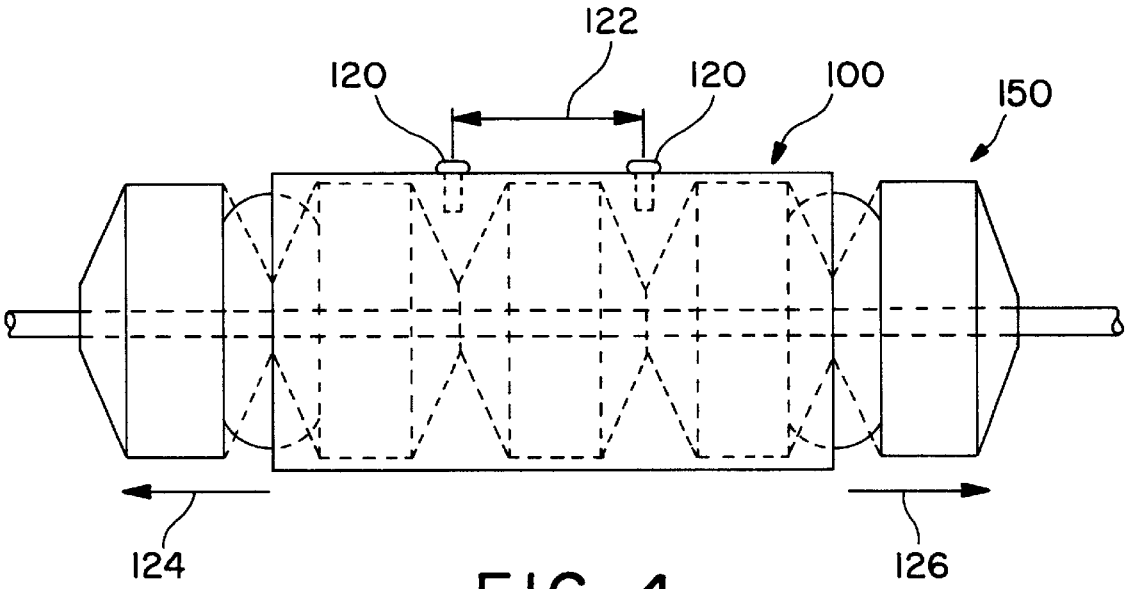
FIG. 4 is a side plan view of the Device For Marking Swimming Pool Lane Dividers installed on a typical swimming pool lane divider.

FIG. 4 shows the device for marking swimming pool lane dividers 100 installed around a swimming pool lane divider 150. When properly installed, the device for marking swimming pool lane dividers 100 may fit over on or more of the independent sections 152 comprising the swimming pool lane divider 150. The holes 118 formed along the top edge 110 and the bottom edge 112 may be spaced apart a distance 122 so that when the fasteners 120 are inserted through the holes 118, they may reside between two of the sections 152 and keep the device for marking swimming pool lane dividers 100 from sliding along the swimming pool lane divider 150 in direction 124 or 126.

In a preferred embodiment, the device for marking swimming pool lane dividers 100 may be manufactured from brightly colored polyethylene. The preferred color may be red or yellow because of its contrast with most existing swimming pool lane divider color(s), and contrast with the pool water and sky when looking up from underwater. It can be appreciated that any other material with similar characteristics well known in the art may be used. Moreover, the color of the device for marking swimming pool lane dividers 100 may be any color which sufficiently contrasts the existing swimming pool lane divider color(s), the water, and the sky.

The length 116 of the device for marking swimming pool lane dividers 100 may be slightly larger than the diameter 156 of the independent sections 152 multiplied by Π (3.14), i.e., the circumference. The length 116 of the device for marking swimming pool lane dividers 100 will allow it to fit easily around the circumference of the independent sections 152 comprising the swimming pool lane divider 150.

The preferred fasteners 120 may be plastic screw-type fasteners that may be snugly inserted to hold the device for marking swimming pool lane dividers 100 in place. These screw-type fasteners 120 may also be easily unscrewed and removed to facilitate moving or changing the device for marking swimming pool lane dividers 100. It can be appreciated that any other fastener with similar characteristics may be used, including but not limited to a metal snap-on/snap-off fastener, rivets, or the like.

Figure 5:
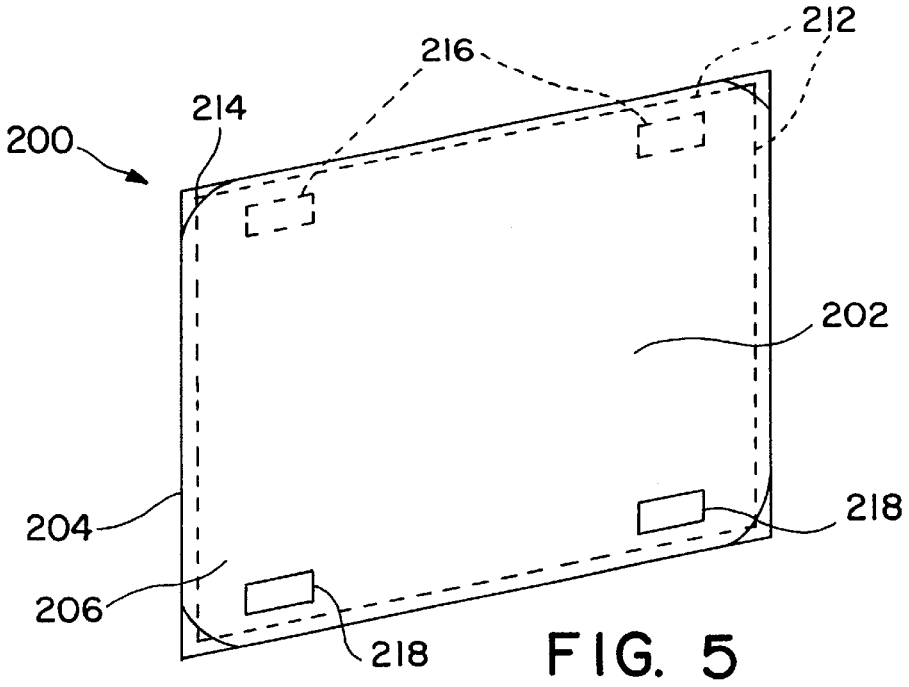

FIG. 5 shows the device for marking swimming pool lane dividers 200. The device is made of cloth and can be brightly colored for easy visual recognition. The device is lying flat so that the outside 202 is facing down. The panel 204 is on the inside 206, which is facing up or nearest to the viewer. The corners 208 of the device can be rounded. The cloth can have contrasting colors that can withstand the high levels of chemicals that the cloth will be in contact with such as chlorine in the pool water. The cloth has a thickness 210 that is stitched with thread 212 that can also withstand chemical agents found in swimming pool water. Also, corners 214 may be rounded in order to avoid sharp edges of the material 204, thereby avoiding any injury to a swimmer who inadvertently hits the device 200 during rigorous swimming activities.

Figure 6:
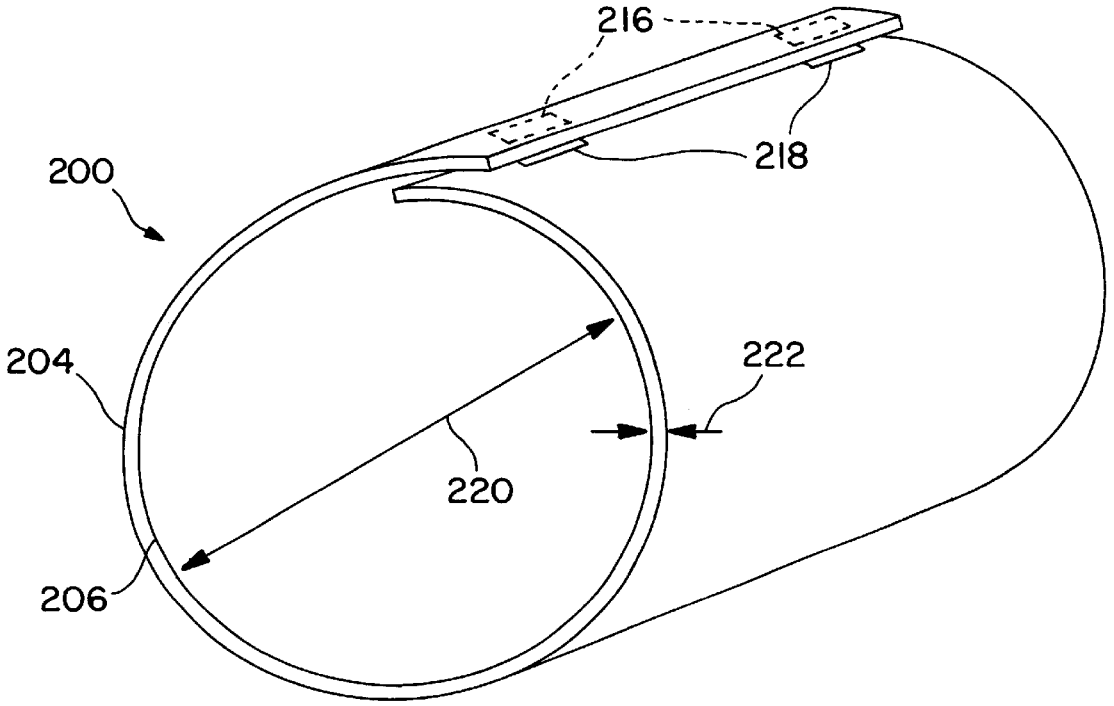

FIG. 6 shows the cloth device described in FIG. 5 when it is connected by the hooks 216 and loops 218. The device has hundreds of hooks and loop fasteners, such as those available under the Velcro brand name. The hooks 216 can be made of a thin plastic or other types of synthetic material that is shaped like a fishing hook without the sharp point. The loops 218 are shaped like a half oval or ellipse that catch and grip the hooks 216 when they are pressed together. The diameter 220 of the device 200 will be will be made to fit around the swimming pool lane divider.

Figure 7:
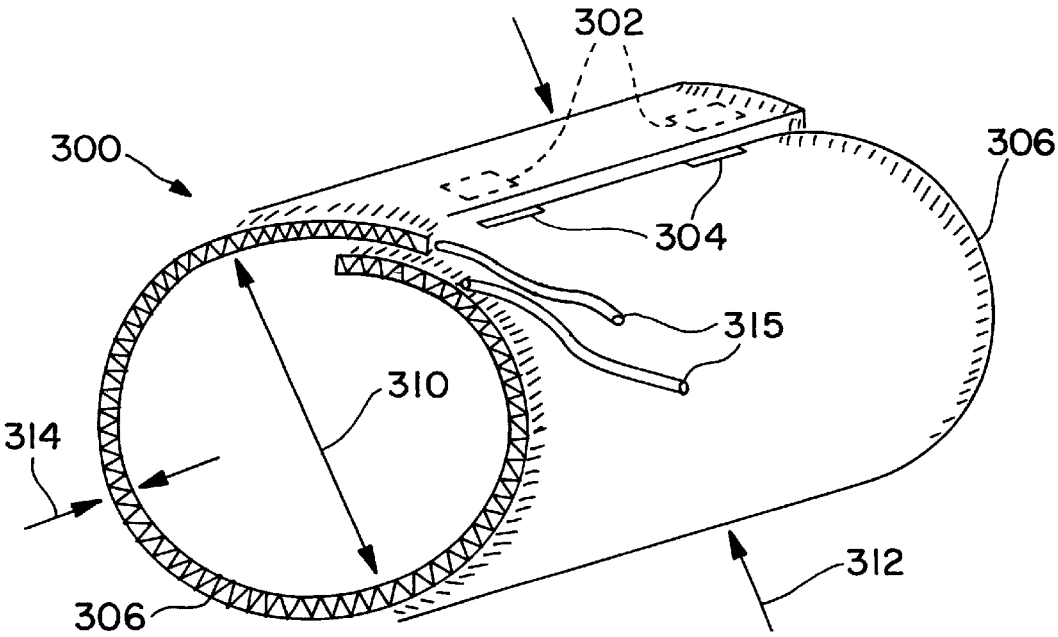

FIG. 7 shows the device that marks swimming pool lanes dividers 300 at a specified length. The device uses a hook 302 and loop 304 like Velcro to keep the device around the lane dividers. The device is held in place on the lane divider by the tight ends 306 that can be stitched tight or elastic. The ends 306 have a shorter diameter 310 than the diameter of the middle section 312 of the device. The cloth material has a thickness of 314, typical of heavy-duty natural or synthetic materials.

In addition to the hook and loop fasteners 302 and 304, device that marks swimming pool lanes dividers 300 may also include a draw-string 315 which allows for the device 300 to be secured along the lane divider simply by positioning the device in place and tying the draw-string snugly about the lane dividers. This draw string 315 may be used independently, or in conjunction with fasteners 302 and 304.

While the device for marking swimming pool lane dividers of the present invention as herein shown and disclosed in detail is fully capable of obtaining the objects and providing the advantages herein before stated, it is to be understood that it is merely illustrative of a preferred embodiment of the invention and that no limitations are intended to the details of construction or design herein shown other than as described in the appended claims.

I claim:

1. A marker for swimming pool lane dividers having sections at least partially separated from each other by a space, said marker comprising:

a flexible sheet having a top edge and a bottom edge; and a fastener for fastening said top edge to said bottom edge wherein said flexible sheet forms a cylindrical cover around said swimming pool lane divider;

wherein a portion of said fastener extends through said flexible sheet and into said space separating said sections.

2. The marker for swimming pool lane dividers of claim 1, wherein said flexible sheet is rectangularly shaped.

3. The marker for swimming pool lane dividers of claim 1, wherein said fastener comprises a screw-type fastener having a head and a shaft, wherein said shaft extends through said flexible sheet into said space.

4. The marker for swimming pool lane dividers of claim 1, wherein said flexible sheet is colored.

5. The marker for swimming pool lane dividers of claim 4, wherein said color of said flexible sheet is red.

6. The marker for swimming pool lane dividers of claim 4, wherein said color of said flexible sheet is green.

7. The marker for swimming pool lane dividers of claim 4, wherein said color of said flexible sheet is blue.

8. The marker for swimming pool lane dividers of claim 1, wherein said flexible sheet is made of polyethylene.

9. The marker for swimming pool lane dividers of claim 1, wherein said flexible sheet is made of cloth.

10. A marker for swimming pool lane dividers, comprising:

a flexible sheet having a top edge, a bottom edge, a right side edge and a left side edge;

a first draw string attached to said right side edge adjacent said top edge of said flexible sheet;

a second draw string attached to said right side edge adjacent said bottom edge of said flexible sheet;

a third draw string attached to said left side edge adjacent said top edge of said flexible sheet;

a fourth draw string attached to said left side edge adjacent said bottom edge of said flexible sheet; and wherein said first draw string and said second draw string may be tied together, and said third draw string and said fourth draw string may be tied together, to secure said marker about said swimming pool lane divider.

11. The marker for swimming pool lane dividers of claim 10, wherein said flexible sheet is made of polyethylene.

12. The marker for swimming pool lane dividers of claim 10, wherein said flexible sheet is made of cloth.

13. A marker for swimming pool lane dividers, comprising:

a flexible sheet having a top edge, a bottom edge, a right side edge and a left side edge;

a first draw string attached to said right side edge adjacent said top edge of said flexible sheet;

a second draw string attached to said right side edge adjacent said bottom edge of said flexible sheet wherein said first draw string and said second draw string may be tied together to secure said marker about said swimming pool lane divider;

a first hook and loop material attached to said top edge; and a second hook and loop material attached to said bottom edge;

wherein said first hook and loop material may be removably attached to said second hook and loop material to secure said marker about said swimming pool lane divider.

14. The marker for swimming pool lane dividers of claim 13, wherein said flexible sheet is made of polyethylene.

15. The marker for swimming pool lane dividers of claim 13, wherein said flexible sheet is made of cloth.

* * * * *